US006092310A

United States Patent [19]

Schoesler

[11] Patent Number: 6,092,310

[45] **Date of Patent: *Jul. 25, 2000**

[54] FLUID FILLED INSOLE

[76] Inventor: Henning R. Schoesler, c/o Faniliew Schoesler, Hopteup Hovedgaoe 77, DK-6100 Hadeeslev, Denmark

[ * ] Notice: This patent is subject to a terminal disclaimer.

[21] Appl. No.: 09/265,044

[22] Filed: Mar. 8, 1999

Related U.S. Application Data

[63] Continuation-in-part of application No. 08/687,787, Jul. 19, 1996, Pat. No. 5,878,510, which is a continuation-in-part of application No. 08/047,685, Apr. 15, 1993, abandoned.

[30] Foreign Application Priority Data

| | | | |
|---|---|---|---|
| Apr. 15, 1994 | [AU] | Australia | 9466766 |
| Apr. 15, 1994 | [CA] | Canada | 2160587 |
| Apr. 15, 1994 | [EP] | European Pat. Off. | 94 914 349 |
| Apr. 15, 1994 | [WO] | WIPO | PCT 94 DK 152 |

[51] Int. Cl.[7] ..... A43B 13/38; A43B 7/14

[52] U.S. Cl. ..... 36/43; 36/71; 36/88; 36/153; 36/29

[58] Field of Search ..... 36/28, 29, 43, 36/44, 71, 88, 93

[56] References Cited

U.S. PATENT DOCUMENTS

| | | |
|---|---|---|
| D. 246,486 | 11/1977 | Nickel . |
| D. 255,060 | 5/1980 | Okazawa . |
| 1,069,001 | 7/1913 | Guy . |
| 1,093,608 | 4/1914 | Delaney . |
| 1,148,376 | 7/1915 | Gay . |
| 1,193,608 | 8/1916 | Poulson . |
| 1,304,915 | 5/1919 | Spinney . |
| 1,781,715 | 11/1930 | Blakely . |
| 2,080,469 | 5/1937 | Gilbert ..... 36/29 |
| 2,080,499 | 5/1937 | Nathansohn . |
| 2,488,382 | 11/1949 | Davis . |
| 2,502,774 | 4/1950 | Alianiello . |
| 2,917,844 | 12/1959 | Scholl . |
| 3,765,422 | 10/1973 | Smith . |
| 3,795,994 | 3/1974 | Ava . |
| 3,871,117 | 3/1975 | Richmond et al. . |
| 3,892,077 | 7/1975 | Wolstenholme et al. . |
| 3,922,801 | 12/1975 | Zente . |

(List continued on next page.)

FOREIGN PATENT DOCUMENTS

| | | |
|---|---|---|
| 27666/84 | 12/1984 | Australia . |
| 3629331A1 | 3/1988 | Germany . |
| 1-126905 | 5/1989 | Japan . |

OTHER PUBLICATIONS

Pittsburgh Plastics Manufacturing fluid filled insole which was believed to have been comercially introduced and sold in or about Mar. 1993.

*Primary Examiner*—M. D. Patterson
*Attorney, Agent, or Firm*—Paul G. Juettner; Greer, Burns & Crain, Ltd

[57] ABSTRACT

A fluid filled insole comprises a fluid tight bladder having upper and lower layers and a generally foot-shaped, planar configuration, with proximal forefoot, midfoot and hindfoot regions; a heavy, viscous, sterile liquid substantially filling the bladder; at least one, preferably between two and six transversely spaced forefoot flow deflectors joining the upper and lower layers in the proximal forefoot region of the bladder; flow passages matched to the anatomical structure of the foot between the forefoot flow deflectors and the medial and lateral and peripheral margins of the bladder; and a flow controller matched to the border between the lateral and medial longitudinal arch. The hindfoot region of the bladder may comprise, alternatively (1) at least one hindfoot flow deflector, (2) flow restrictors in the distal hindfoot defining a central longitudinal flow channel between the hindfoot and midfoot regions, or (3) a barrier between the midfoot and hindfoot regions, and the hindfoot region comprising at least in part of a shock absorbing material. The flow of fluid within the insole is thereby matched to the anatomical structure of functionally normal feet.

7 Claims, 4 Drawing Sheets

U.S. PATENT DOCUMENTS

| | | | |
|---|---|---|---|
| 3,990,457 | 11/1976 | Voorhees . | |
| 4,100,686 | 7/1978 | Sgarlato et al. . | |
| 4,115,934 | 9/1978 | Hill . | |
| 4,123,855 | 11/1978 | Thedford | 36/29 |
| 4,183,156 | 1/1980 | Rudy . | |
| 4,217,705 | 8/1980 | Donzis . | |
| 4,219,945 | 9/1980 | Rudy . | |
| 4,297,797 | 11/1981 | Meyers . | |
| 4,336,661 | 6/1982 | Medrano . | |
| 4,471,538 | 9/1984 | Pomeranz et al. | 36/43 |
| 4,472,890 | 9/1984 | Gilbert . | |
| 4,567,677 | 2/1986 | Zona . | |
| 4,590,689 | 5/1986 | Rosenberg . | |
| 4,602,442 | 7/1986 | Revill et al. . | |
| 4,799,319 | 1/1989 | Zellweger . | |
| 4,845,861 | 7/1989 | Moumdjian . | |
| 4,934,070 | 6/1990 | Mauger . | |
| 4,934,072 | 6/1990 | Fredericksen et al. . | |
| 4,991,317 | 2/1991 | Lakic | 36/29 |
| 5,067,255 | 11/1991 | Hutcheson . | |
| 5,097,607 | 3/1992 | Fredericksen . | |
| 5,203,793 | 4/1993 | Lyden | 36/43 |
| 5,313,717 | 5/1994 | Allen et al. | 36/29 |
| 5,406,719 | 4/1995 | Potter . | |
| 5,878,510 | 3/1999 | Schoesler | 36/43 |

FIG. 1-B

FIG. 1-C
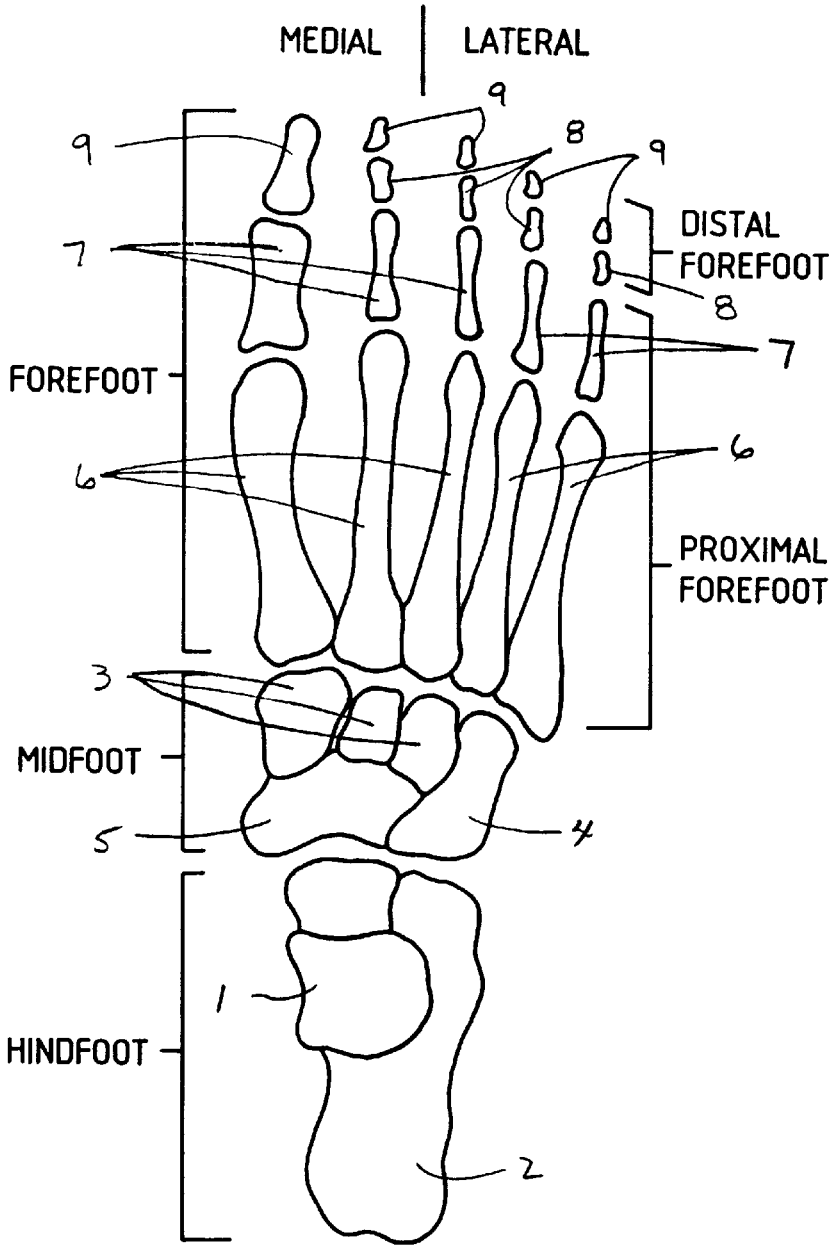
FIG. 2
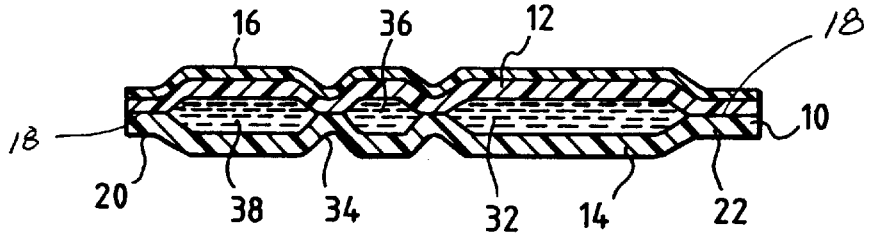

FLUID FILLED INSOLE

CROSS REFERENCE

This application is a continuation-in-part of application Ser. No. 08/687,787 filed Jul. 19, 1996, now U.S. Pat. No. 5,878,510 which is a continuation-in-part of application Ser. No. 08/047,685 filed on Apr. 15, 1993, now abandoned.

BACKGROUND OF THE INVENTION

The present invention is directed to therapeutic fluid filled insoles, and more particularly to insole bladders having fluid flow directing and controlling members within the bladder with the purpose of achieving improved medical benefits and directional stability to the users.

Fluid filled insoles have long been known in the art, see for example, U.S. Pat. No. 4,567,677 to James Zona, U.S. Pat. No. 4,115,934 to Hall, U.S. Pat. No. 4,123,855 to Thedford, U.S. Pat. No. 2,080,469 to Gilbert and U.S. Design Pat. No. D246,486 to John W. Nickel. Prior art insoles commonly comprise a bladder having an upper layer and a lower layer. The two layers are welded together at their marginal periphery. The bladder has a planar, foot-shaped configuration, which includes a forefoot region, a hindfoot region, and a midfoot region there between. The bladder is filled with a fluid, such as water or air. The broader technical functions of fluid filled insoles are well documented, whereas the medical benefits are only partly documented. It is not generally known that fluid filled insoles may be designed to accomplish specific medical benefits. Two significant limitations in the prior art are: (1) the flow of liquid/fluid is not matched to the anatomical structure of the foot, and (2) flow of fluid does not provide directional stability. The known technical functions include cushioning of the feet by a massaging action on the plantar surface of the feet due to movement of the fluid within the bladder, thus achieving comfort to the user.

The fluid filled insoles of the prior art have not been entirely satisfactory, however, in the area of providing demonstrative medical benefits, neither as a device for relieving fatigue in the lower extremities by providing pressure or stress distribution and activation of the venous pump function nor for achieving directional stability to the user when wearing the insole. Existing prior art insoles have little or no means for: (1) controlling both the transverse and longitudinal flow, (2) controlling the rate of fluid flow within the insole, or (3) matching the flow of fluid to the anatomical structure of the foot. As a user walks, the user's weight is initially applied to heel, and then is transferred to the ball of the foot. This causes the fluid within the bladder to move, respectively, from the hindfoot region to the forefoot region and then back towards the hindfoot again. Further, without means for directing fluid flow anatomically within the bladder, the fluid will flow uncontrollably and thus causing directional instability to the user when wearing the insole. Without means for controlling and restricting the rate of fluid flow vis-à-vis the viscosity and density of the fluid, the foot will simply "jump through" the fluid in the insole when the wearer's weight is applied, and thus the fluid insole has little pressure distribution or massaging effect.

Some prior art devices, such as the insole of the Zona patent, have attempted to regulate flow from the hindfoot region to forefoot region and vice versa by placing flow restricting means in the midfoot area of the bladder. These flow restricting devices are only partly effective, however, since they neither match the anatomical structure of the foot nor control the flow within the forefoot or hindfoot regions of the bladder to achieve directional stability and local pressure distribution. In addition, the midfoot flow restricting means are not matched to the anatomical structure of the longitudinal medial arch. Matching the anatomical structure of the foot to the location, direction, quantity and duration of fluid flow fully determine therapeutic benefits, pressure distribution and directional stability.

Some prior art insoles, as shown for example in the Hall or Nickel patents have attempted to regulate fluid flow within the forefoot and hindfoot regions. But, these efforts have not been satisfactory because the fluid flow is not matched to the anatomical structure of said local regions, but rather directed to the outer, medial and lateral, margins of the insole, away from the areas of the foot where fluid massaging action and pressure distribution are required when considering the physiology and anatomy of the foot.

The Thedford patent has also attempted to regulate fluid flow within the forefoot and hindfoot regions. These teachings have not been anatomically satisfactory because the fluid flow is neither adapted to the anatomical structure of the foot nor arranged in a fashion that achieves directional stability to the user during the flow of fluid within the insole. Further, the Thedford patent teaches prohibition or blocking of longitudinal flow within the bladder, redirecting the flow in a transverse direction.

The Gilbert patent has attempted to regulate fluid flow by randomly dispersing flow restrictors across the entire surface of the insole, which, again, does neither match the anatomical structure of the foot nor achieve directional stability. The Gilbert patent does not specify any particular arrangement of flow restrictors or fluid flow, but teaches that the "spots" "may be disposed at any desirable location with any desirable frequency" which makes flow control indefinite. Further, the Gilbert patent permits air to shift in any direction and partly arranges flow restricting means to block longitudinal flow.

Many prior art insoles are filled with ordinary water or other fluids that not only quickly evaporate and thus significantly reduce the industrial applicability (life time) of the insole, but also develops bacteria and/or other microorganisms, causing the fluid to become toxic and thus environmentally unsafe. In addition, existing prior art insoles do not consider the fluid itself as a flow restricting means and thus significantly limits the therapeutic value of the insole by allowing the fluid to flow at a rate that cannot satisfactorily provide pressure distribution. The rate of fluid flow significantly influences pressure distribution.

Finally, none of the prior art insoles considers local pressure distribution within each of the midfoot, forefoot and hindfoot regions of the bladder by directing and anatomically controlling the flow of fluid within each of the midfoot, forefoot and hindfoot regions. This lacking consideration significantly limits the medical and therapeutic applications of the prior art insoles. It would be desirable to have a fluid filled insole that (i) controls and directs the fluid to match the anatomical structure of the foot and achieves directional stability to the user wearing the insole, (ii) maximizes pressure distribution to minimize peak pressures on the foot, both across the entire area of the foot and within each of the hindfoot, midfoot and forefoot regions, (iii) ensures minimum evaporation of the fluid to maximize the life time of the insole, (iv) provides a fluid that is environmentally safe, and (v) devises a fluid that functions as a flow restricting means vis-a-vis the density and viscosity of the fluid to enable maximum pressure distribution, and which otherwise overcomes the limitations inherent in the prior art.

OBJECTS OF THE INVENTION

It is an object of the invention to provide an insole that has a superior therapeutic fatigue-relieving effect by providing maximum pressure distribution in each of the hindfoot, midfoot and forefoot areas of the plantar surface of the user's foot, while improving the muscular venous pump function by means of the flow of fluid interacting with foot movements.

It is a further object of the invention to provide a fluid filled insole wherein the fluid flow matches the anatomical structure of functionally normal feet; the fluid being directed and controlled in transverse and longitudinal flow passages that are adapted to the anatomical structure of functionally normal feet, thereby achieving directional stability for the user when wearing the insole.

It is another object of the invention to provide a liquid filled insole that increases the weight bearing surface area of the user's foot by improving the distribution of the user's weight both over the total area of the foot and within each of the hindfoot, midfoot and forefoot regions, thereby reducing peak pressures on the plantar surface of the user's foot.

It is a fourth object of the invention to provide an insole filled with a sterile, non-toxic, non-greasy fluid that not only has low evaporation rates but also remains environmentally safe during the entire life time of the insole.

It is a fifth object of the invention to provide a liquid filled insole that is durable and not prone to lose fluid by leakage, evaporation or diffusion, thus prolonging the life time of the insole.

It is a sixth object of the invention to provide a fluid filled insole that increases the weight bearing surface within each of the forefoot, midfoot and hindfoot regions by (i) restricting the flow of liquid between the three regions and by (ii) directing and controlling the liquid within each of the regions (local pressure distribution).

It is a seventh object of the invention to provide a fluid filled insole that provides shock absorption in the heel area and maximizes pressure distribution within each of the forefoot and midfoot regions.

It is an eighth object of the invention to provide a fluid filled insole that accumulates anatomically optional quantities of liquid within each of the hindfoot and forefoot areas to enable optimal pressure distribution.

SUMMARY OF THE INVENTION

The insole of the invention comprises a fluid tight bladder having an upper layer of flexible material and a lower layer of flexible material sealingly joined together at their peripheral margins. The bladder has a generally foot shaped planar configuration, with a proximal forefoot region, a hindfoot region, and a midfoot region there between. The bladder is filled with a large molecular, non-evaporable, highly viscous, sterile liquid, preferably a mixture of hygroscopic, polyvalent alcohol and distilled water. Within the proximal forefoot region of the bladder is positioned, at least one, but optimally between two and five flow deflectors, adjacent flow deflectors substantially equally spaced transversely from the imaginary longitudinal centerlines of each other, and spaced from the medial and lateral margins of the bladder. The flow deflectors comprise weld points joining the upper and lower bladder layers. Substantially equally sized longitudinal flow channels are formed between the flow deflectors and between the flow deflectors and medial and lateral margins of the bladder.

Bridging the proximal forefoot region and the midfoot region of the bladder is a flow controller, which is generally anatomically matched to the structure of the longitudinal arches of a functionally normal foot. The arch flow controller comprises an elongated, semicircular shaped weld, between the upper and lower bladder layers. The longitudinal arch flow controller and the medial peripheral margin of the bladder define a semi-enclosed volume. In use, a liquid pad or pillow is formed that substantially underlies the anatomical structure of the medial longitudinal arch region of a functionally normal foot.

In accordance with the present invention, there are alternate configurations in the hindfoot region of the insole. In a first embodiment, between one and five hindfoot flow defectors are located in the hindfoot region. At least two longitudinal channels are formed between the hindfoot flow deflector(s) and the medial and lateral margins of the bladder. If two or more are so used, at least one longitudinal hindfoot flow channel is formed between the hindfoot deflectors. Thereby, fluid flowing within the hindfoot and forefoot regions and from these regions into the midfoot region and vice versa will be channeled through the longitudinal flow channels in the forefoot and hindfoot regions in a controlled fashion, resulting in enhanced medical and therapeutic benefits as explained below.

A second and most preferred embodiment of the invention is characterized by a pair of flow restrictors at the distal end of the hindfoot region, one on the lateral margin of the bladder and the other on the medial margin. The pair of hindfoot restrictors form a longitudinal flow channel there between. The proximal hindfoot region is free of flow deflectors or the like.

A third embodiment of the invention is characterized by a shock absorbing pad provided in at least a portion of the hindfoot region. A barrier is placed between the midfoot and hindfoot regions to prevent the shock absorbing pad from being saturated with liquid. The pad preferably underlies the heel bone.

The bladder is filled with a large molecular, non-evaporable, highly viscous, sterile liquid, preferably a mixture of hygroscopic, polyvalent alcohol and distilled water. The fluid has a viscosity and density of at least 1.10 times that of ordinary water. I refer to this as a "heavy liquid." For the above reasons, the density of the fluid, measured by g/m3, is higher than the density of water (density=weight), because a higher weight of the fluid (compared to water) restricts the rate of fluid flow. For the same reasons, the thickness (viscosity) is also higher than that of water, because a higher thickness of the fluid (compared to water) restricts the rate of fluid flow. This mixture is sterile, non-toxic and resistant to contamination by bacteria or other microorganisms, thereby ensuring an environmentally safe fluid within the insole. Further, the mixture of hygroscopic, polyvalent alcohol and distilled water is not susceptible to evaporation or diffusion through the bladder layers. It is also autoclavable. In the event of a bladder puncture, the liquid may be easily removed from clothing and footwear, as the mixture is also relatively non-greasy.

The insole of the invention has been tested and found to provide several desirable medical benefits. The insole relieves fatigue during prolonged standing or walking by distributing the user's weight anatomically over the area of the foot. The weight bearing surface area of the wearer's feet is increased, thereby reducing peak pressures exerted on the plantar surface of the user's foot and resulting deformation of soft tissue. The reduction in pressure thereby further relieves stress on the bones of the foot that can cause foot pain, hard skin and in extreme situations, ulceration.

Second, the anatomically controlled flow of fluid through the bladder across the plantar surface of the user's feet provides a therapeutic movement of the small intrinsic muscles of the feet. The movement of the muscles animates the venous pump function increasing blood circulation, which in turn improves transport of oxygen and nutrients to the cells in the foot and removal of waste products excreted from the cells.

Third, the specific locations of the flow deflectors enable a fluid flow that is matched to the anatomical structure of the foot and thus aid in anatomically correct locomotion. This in turn provides not only directional stability when the fluid moves within the insole, but also alleviates the foot abnormalities over supination and over pronation found in asymmetric feet.

Other attributes and benefits of the present invention will become apparent from the following detailed specification when read in conjunction with the accompanying drawings.

BRIEF DESCRIPTION OF THE DRAWINGS

FIG. 1-B is a plan view of the human foot illustrating the medial and lateral portions thereof, and showing a typical weight distribution pattern of a normal foot.

FIG. 1-C is a dorsal view of the bones of the human foot.

FIG. 2 is a cross-sectional view of the first embodiment of the invention taken along line 2—2 of FIG. 1.

DETAILED DESCRIPTION

Figure 1:
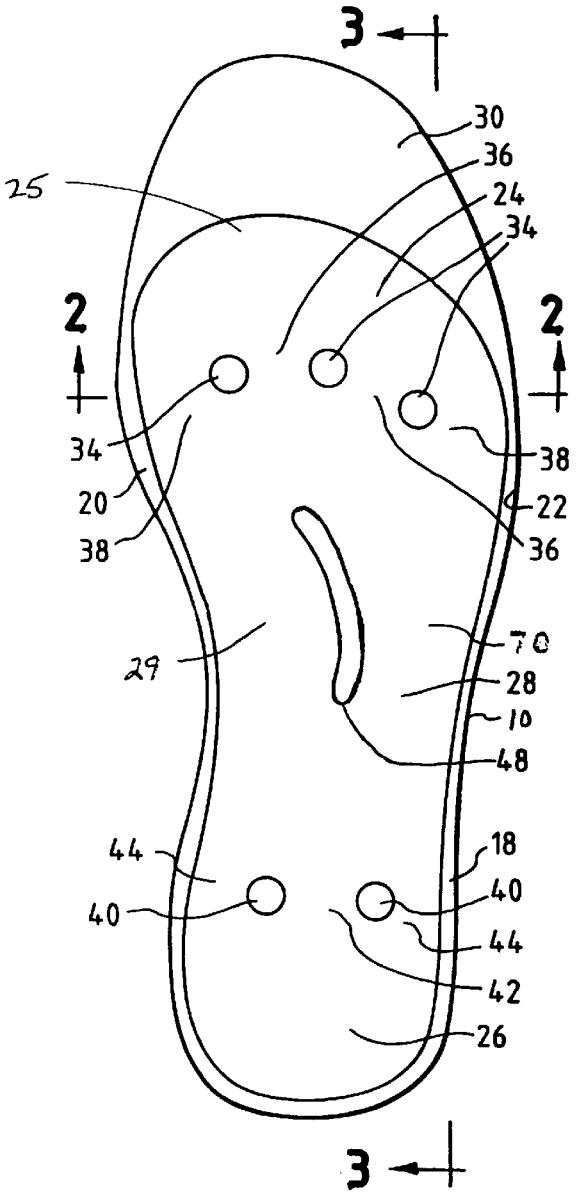
FIG. 1 is a plan view of a first embodiment of the fluid filled insole of the invention.
Figure 1:
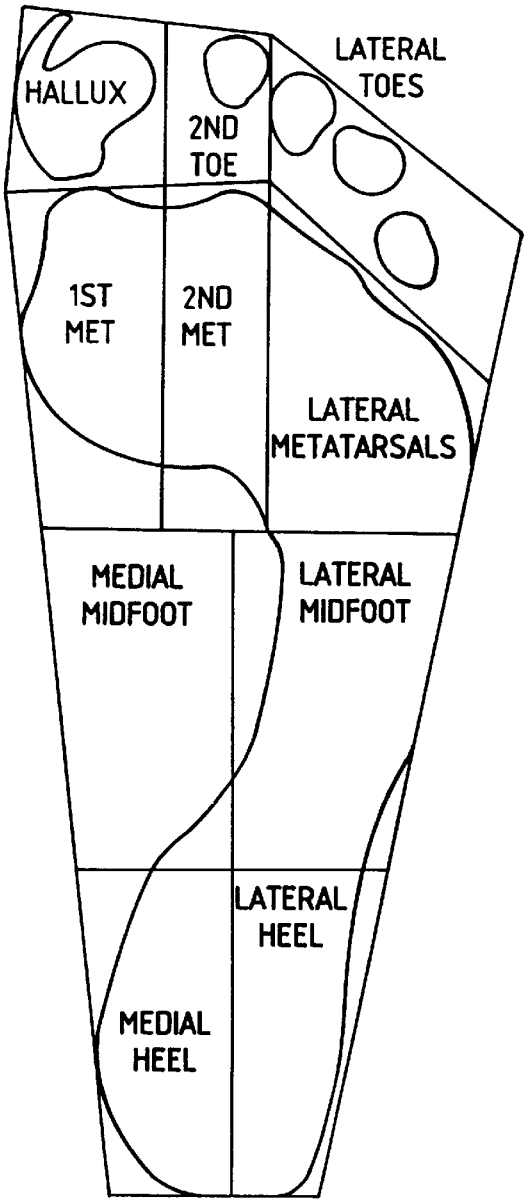

Turning now to the drawings, FIGS. 1-B and 1-C illustrate the structure of the human foot. The foot comprises a (i) hindfoot region containing the talus 1 and os calcis 2 bones; (ii) a midfoot region containing the cuneiform 3, cuboid 4 and navicular 5 bones; and the forefoot region comprising the metatarsals 6, the proximal phalanges 7, and the middle 8 and distal 9 phalanges. The forefoot region can be divided into two sub-regions, the distal sub-region comprising the middle and distal phalanges, and the proximal forefoot region which comprises the metatarsals and proximal phalanges. The foot also includes a longitudinal arch, having a medial and a lateral side. The medial longitudinal arch is defined by the navicular and medial cuneiform bones of the midfoot and the about the proximal half of the first, second and third metatarsals. The typical weight bearing area of a normal foot appears from FIG. 1-B. The weight is not equally distributed over the plantar area of the foot. In a functionally normal foot, the medial midfoot typically bears only limited weight.

Figure 3:
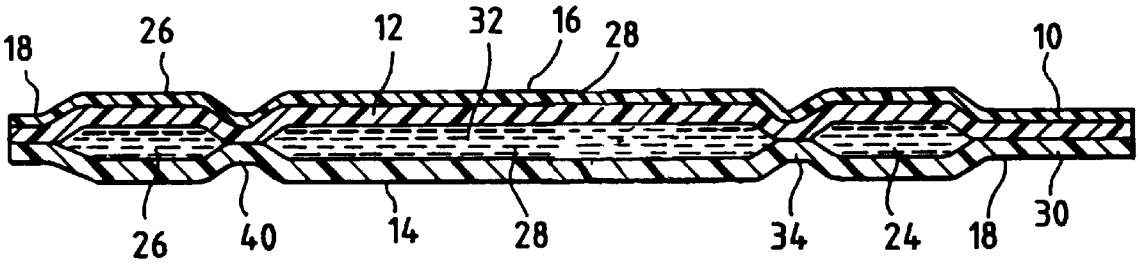
FIG. 3 is a cross sectional view of the first embodiment of the invention taken along line 3—3 of FIG. 1.

In FIGS. 1 through 3, a first embodiment of the fluid filled insole of the invention is shown. The insole comprises a bladder 10 having an upper layer 12 and a lower layer 14. The insole preferably further includes a layer of textile or a sweat absorbing material 16 substantially covering and laminated to the outer surface of upper layer 12. Optionally a textile layer could be added to the bottom surface of the insole. The bladder layers 12 and 14 are sealing joined at their peripheral margins 18. For reference, the medial peripheral margin is numbered 20 and the lateral peripheral margin is numbered 22. The bladder comprises three main regions, namely a forefoot region 25, a hindfoot region 26 and a midfoot region 28 there between. The forefoot region is divided into a distal subregion 30 and a proximal forefoot region 24.

The interior cavity 32 of the bladder 10 is filled with a sterile, non-toxic, non-evaporable fluid with a density and viscosity of at least 1.10 times that of water. The fluid is preferably a "heavy liquid" mixture of large molecular, hygroscopic polyvalent alcohol and distilled water, as is more fully described below. In the first embodiment the fluid may flow between and throughout the proximal forefoot, midfoot and hindfoot regions. The distal forefoot sub-region 30 preferably does not contain fluid. Within the proximal forefoot region 24 of bladder 22 there are at least one, but preferably between two and six transversely spaced flow deflectors 34. In the illustrated embodiment there are three forefoot flow deflectors 34, but, one could employ between one and six forefoot flow deflectors. The shape of the flow deflectors is preferably circular or oval, but other shapes may alternatively be used. The space between each of the flow deflectors and between the flow deflectors and the medial and lateral peripheral margins of the bladder forms substantially longitudinal forefoot flow passages. This means that the distance between the imaginary longitudinal centerlines of adjacent deflectors is substantially equally dimensioned or sized. Each flow passage between adjacent deflectors has a substantially equal transverse dimension, $W_m$. By "substantially equal transverse dimension," I mean between 0.95 and 1.05 times $W_m$, where $W_m$ is calculated as follows:

$$W_m=(D_m-S_m)/(N_m+1)$$

$D_m$ is the maximum straight transverse width of the forefoot region, $S_m$ is the sum of the transverse dimensions of the forefoot flow deflectors, and $N_m$ is the number of forefoot flow deflectors.

The forefoot flow deflectors are arranged in a shape to form flow passages that laterally, medially, transversely and longitudinally matches the anatomical structure of the proximal forefoot region, the shape being for example, but not limited to, an arc, a semicircle, or a trapezoid, the convex side of the shape facing in a distal direction. The spacing between the flow deflectors depends on (i) the shoe or foot size, (ii) the diameter of the flow deflectors, and (iii) the number of flow deflectors. With two forefoot flow deflectors, the spacing from imaginary longitudinal centerline to centerline between flow deflectors would be 33% or one third of the transverse straight distance between the lateral and medial peripheral margins of the bladder measured at the location of the flow deflectors. If n flow deflectors are placed in the proximal forefoot region, then n+1 longitudinal flow passages are formed.

The flow deflectors 34 are formed by weld points joining the upper bladder layer 12 to the lower bladder layer 14. Formation of flow deflectors by welding points joining the bladder layers improves the structural integrity of the bladder, improving durability. Between flow deflectors 34 are flow passages 36 through which fluid flows during use of the insole. Additional flow passages 38 are also formed in the proximal forefoot region between flow deflectors 34 and the medial peripheral margin 20, and between flow deflectors 34 and the lateral peripheral margin 22. The forefoot flow passages 36 and 38 extend in a straight, longitudinal direction. By "longitudinal" it is meant that the flow direction varies by no more than 10 degrees (plus or minus) from the imaginary straight longitudinal axis of the insole. At least one passage flows in an unobstructed path to the mid foot region of the bladder. Flow deflectors 34 are shown as being circular, but other shapes, such as oval or ellipse, may be alternatively used.

Bridging the proximal forefoot region and the midfoot region 28 of bladder 10 is a flow controller 48, which is generally matched to the wearer's arch. The arch flow controller may be configured in several different ways, but must match the contour or anatomical structure of the longitudinal arches of a normal foot, as described above in reference to FIGS. 1-B and 1-C. The lateral edge of the longitudinal medial arch is generally an elongated, semicircular line substantially at the longitudinal border of the lateral and medial arch of a normal foot, such as shown in FIG. 1-B. The longitudinal medial arch extends from the proximal part of the midfoot area to about the mid-point of the metatarsals, as shown in FIG. 1-B. Flow controller 48 is shaped and located to match at least a portion of the border between the medial and lateral longitudinal arch. A midfoot flow channel 70 is formed on the lateral side of controller 48. A semi-enclosed area or volume 29 is defined by the longitudinal arch flow controller 48 and the medial peripheral margin of the bladder that substantially matches the anatomical structure of the medial longitudinal arch region of a normal foot. In this way, liquid will flow from the proximal forefoot region and into the medial arch region, thus forming a liquid pad or pillow substantially under the area of the medial arch.

In accordance with the present invention there are three alternate configurations for the hindfoot region of the insole of the invention. In the first embodiment, FIGS. 1–3, the hindfoot region 26 of bladder 10 includes at least one but no more than five flow deflectors 40. Because the hindfoot region is a smaller area than the forefoot region, two flow deflectors are preferably used. Alternatively, one, three, four or five could be used in this first embodiment. The hindfoot flow deflectors 40 are formed in the same manner as the forefoot flow deflectors, by a weld point joining the upper and lower bladder layers 12 and 14. At least one generally longitudinal flow passage 42 is formed between hindfoot flow deflectors 40, if two or more hindfoot deflectors are used. Additional hindfoot flow passages 44 are formed between hindfoot deflectors 40 and the medial and lateral peripheral margins of the bladder.

Figure 4:
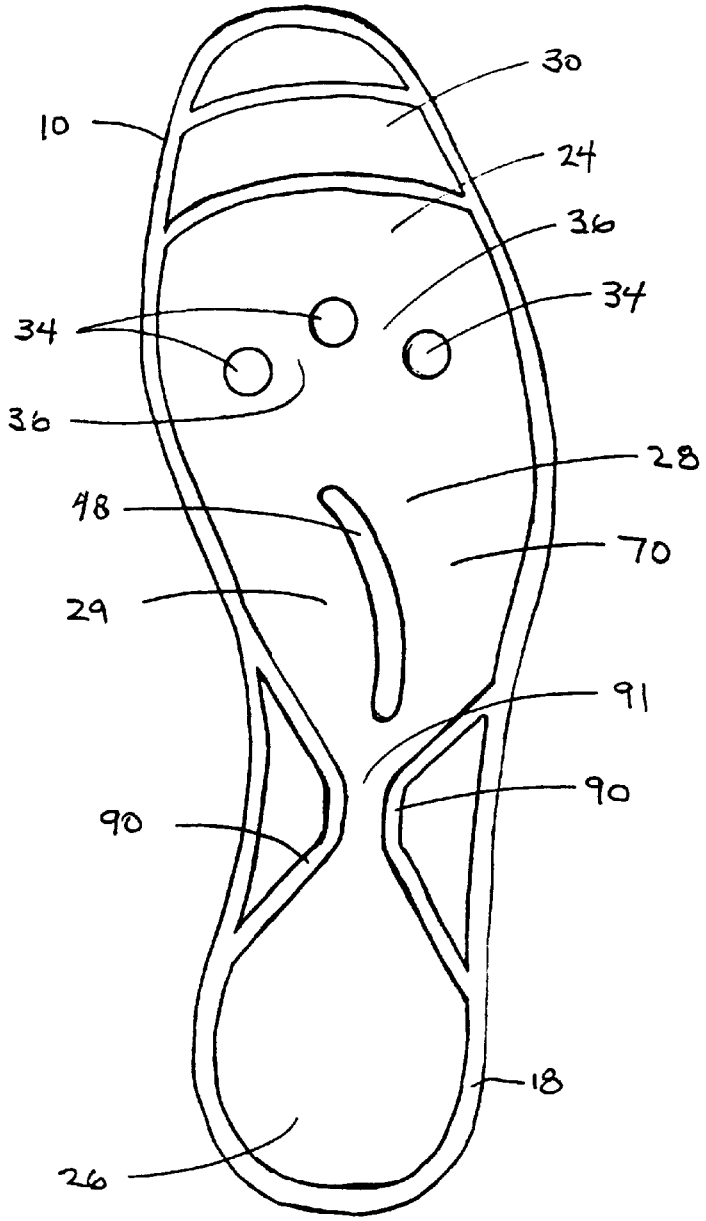
FIG. 4 is a plan view of a second embodiment of the invention.
Figure 5:
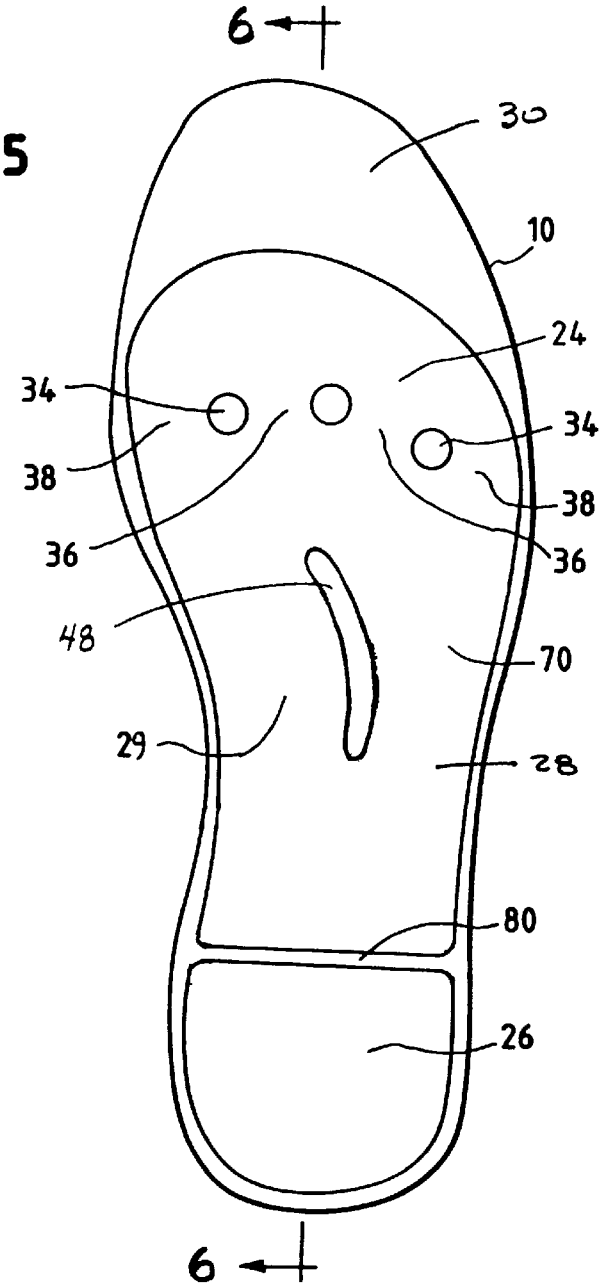
FIG. 5 is a plan view of a third embodiment of the invention.
Figure 6:
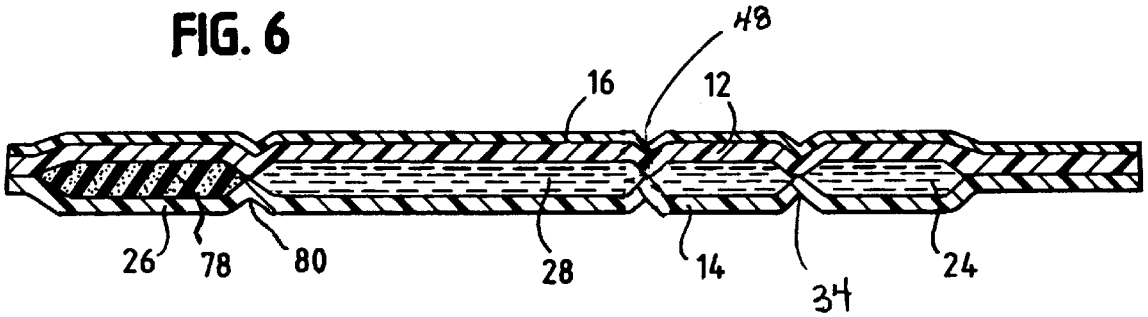
FIG. 6 is a cross-sectional view of the third embodiment of the invention taken along line 6—6 of FIG. 9.

The second and most preferred embodiment of the fluid filled insole of the invention is illustrated in FIG. 4. The second embodiment is similar to the first embodiment, except as to the construction of the hindfoot region. There are no flow deflectors in the hindfoot region, however, there are flow restricting features in the distal part of the hindfoot region that regulate the flow of fluid into and out of the hindfoot region. Specifically, a pair of flow restrictors 90 are located adjacent to the lateral and medial peripheral margins, respectively, in the distal end of the hindfoot region, roughly at the border between the hindfoot and midfoot regions. This pair of hindfoot flow restrictors defines a longitudinal channel 91 there between, the channel 91 having a transverse width of between 10 and 30 percent of the maximum straight transverse width of the hindfoot region of the bladder. The second embodiment preferably includes a longitudinal arch flow controller similar to flow controller 48. The weld 48 is placed substantially at the border between the longitudinal lateral and medial arches, such as depicted in FIG. 1-B, and is similar to weld line 48 of the first embodiment FIG. 5 and 6 illustrate a third embodiment of the invention. The third embodiment is similar to the other embodiments, except for the construction of the hindfoot region. In this embodiment, at least a portion of the hindfoot region comprises a shock absorbing foam material or a non-flowable, semi-solid gel, as opposed to a flowable liquid filled bladder. More specifically, the third embodiment comprises a bladder 10 having an upper layer 12 and a lower layer 14. Preferably, a layer of textile or a sweat absorbing material 16 is laminated to the outer surface of the upper layer 14. The bladder 10 has a liquid filled proximal forefoot region 24 and midfoot region 28. The proximal forefoot region 24 includes transversely spaced flow deflectors 34 and longitudinal flow channels 36 and 38 as described above. The arch region includes a flow controller 48 and lateral flow passage 70. The insole further comprises a hindfoot region 26 and a distal forefoot region 30, but these latter two regions are not filled with flowable liquid. Rather distal forefoot region 30 is unfilled and hindfoot region 26 is at least partially filled with either a static, non-flowable, semi-solid gel or a shock absorbing foam cushion 78. A barrier wall 80 separates the flowable liquid filled regions 24 and 28 from the hindfoot region 26 and prevents liquid from flowing from the proximal forefoot and midfoot regions into the hindfoot region. The shock absorbing pad need not cover the entire area of the hindfoot region. It is necessary only to cover the area beneath the heel bone.

The bladder is preferably fabricated from polyurethane film although other thermoplastic materials, such as EVA, PVC or vinyl may also be used. The thickness of each bladder layer should be from about 300 to 800 micrometers, 400 micrometers being preferred. The sweat absorbing material is preferably about 250 micrometers in thickness. Other textile materials may be used for comfort or breathability regardless of sweat absorbing properties. The bladder may be formed by conventional radio frequency or dielectric welding techniques. Other welding techniques, such as thermal welding may be used alternatively. The bladder is filled with the liquid mixture leaving an opening in the peripheral weld, through which liquid may be introduced, then sealing the opening. The insole of the invention may be made and sold as an insole for removable placement in shoes by the user. Also, the insole may be built into footwear as a permanent feature.

The fluid used to fill the cavity 32 of the bladder 10 is preferably a mixture of distilled water and a sterile, non-toxic, non-evaporable, large molecular, hygroscopic liquid to prevent evaporation or diffusion through the bladder. Polyvalent alcohols with large molecules and with non-toxic properties are preferred. One suitable formulation comprises approximately 85–98%, hygroscopic polyvalent alcohol and approximately 2–15% distilled water. By using this mixture in lieu of plain water, improved benefits are achieved: The mixture of the invention as compared to water does not evaporate or diffuse through the bladder layers, thereby significantly improving life time and durability of the insole. The liquid can withstand autoclaving as may be required by health care institutions. The insoles can be used in temperature ranges from minus 20 degrees Celsius to plus 120 degrees Celsius, because both the liquid mixture and bladder materials can withstand these temperature extremes. The liquid is fully sterile and non-toxic, and thus environmentally safe.

The sterility and/or non toxicness of the fluid is extremely important for several reasons. Children, people and animals could bite the insole, possibly drinking or swallowing the liquid. Water becomes septic after a few months of storage within insoles, because bacteria will grow and flourish in the water.

Compared to water, the mixture of polyvalent alcohol and distilled water has a significantly higher density and viscosity. The fluid of the invention has a preferred density and viscosity range of at least 1.10 times that of water. The actual filling of fluid with a particular density that is at least 1.10 times that of water depends on the flow controlling means within the bladder. Generally, the more the flow of liquid within the bladder is restricted by flow controlling means in the forefoot, midfoot and hindfoot regions, the lower the requirement for the density and viscosity of the liquid. Inversely, the fewer flow controlling means within the bladder, the higher the density and viscosity required. The density and viscosity of the fluid causes an improvement in the effects on the user's foot when wearing the insoles, because the density and viscosity generally controls the rate of flow of the viscous liquid within the insole. In this way, the density and viscosity strongly influence not only the degree of pressure distribution with following reduction of peak pressures on the plantar surface of the foot, but also directional stability.

The liquid used is a thick or heavy liquid that is resistant to flow, but not so thick that flow is unduly restricted. It is intended that when body weight is applied to one area of the bladder, the fluid will slowly and gradually flow out of the area after application of load over a few milliseconds of time, thus the fluid is functioning as a flow restricting means and thereby enable an improved weight pressure distribution as compared to the fluid being ordinary water. Preferably, the fluid does not leave a region before the weight load is applied to that region. Referring to FIG. 4 as an example, when a user places his/her heel to the hindfoot region the fluid will not immediately leave the region, i.e., the fluid will not "jump" out of that area upon application of load. Rather, the fluid will not flow out of the hindfoot region before application of weight load has occurred. I refer to this as a "heavy liquid." For the above reasons, the density of said fluid, measured by g/m3, is higher than the density of water (density=weight), because a higher weight of the fluid (compared to water) restricts the rate of flow of fluid. For same reasons, the thickness (viscosity) is also higher than water, because a higher thickness of the fluid (compared to water) restricts the flow of fluid, and thus enable application of weight load before the fluid leaves a region.

The liquid is relatively non-greasy. Thus, if the insoles are punctured or for any reason the liquid runs out into the user's socks or shoes, the shoes and socks may be readily cleaned.

Testing has shown that there are four basic beneficial effects from wearing the insoles of the invention, namely: (1) reducing pressure on the foot; (2) improves the venous pump function by causing a movement of all the small intrinsic foot muscles; (3) symmetric walking, and (4) directional stability. Each of these therapeutic benefits will be explained in turn.

In the body, blood is pumped from the heart through the arteries out to the energy consuming muscles, where the blood carries the various energy substances such as carbohydrates and oxygen. Within the muscles, the energy is subsequently provided by an oxidation process in which carbohydrates interact with oxygen creating carbon dioxide, water and energy. If a person is working extremely hard—resulting in substantial use of muscles—the oxygen supplied to the muscles (through the blood supply) is insufficient to supply the muscles with sufficient energy. Energy may also be produced in the muscles by splitting of glycogen into lactic acid and energy. Glycogen is a substance in the muscles. The oxygen-poor blood and cell waste products that have resulted from the energy production will then be transported through the veins back to the heart and the purifying organs of the body. The veins function with the muscles to form a venous pump system that eases the transport of the blood back to the heart. The venous pump functions in cooperation with the muscle activity since the moving muscles cause the veins to stretch and contract. Since the veins internally are equipped with valves (flaps) that prevent the blood from flowing away from the heart, the muscle activity on the veins causes the veins to function as a pump system that significantly increases blood transportation back to the heart.

When an individual is standing or walking for more than four hours per day, the foot muscles may receive insufficient movement and exercise. Individual movement of the many small muscles in the foot is hindered. If the foot muscles have insufficient strength, they do not have the sustaining strength to maintain the weight of the body, and the heel bone and metatarsal bones may sink downwardly. The following chain reaction occurs:

1. When the feet collapse ("sink down"), the foot muscles are compressed, which reduces blood flow. Simultaneously, low muscle activity from the compression of the foot muscles causes a reduction of the venous pump function.
2. The foot muscles do not receive sufficient oxygen and carbohydrate quantities for maintaining adequate energy production and oxidation.
3. Because of the constant pressure and lack of supply of oxygen and carbohydrates, the foot muscles start to produce energy by splitting of glycogen to lactic acid and energy.
4. Because blood circulation is hindered, the process will accumulate lactic acid in the foot muscles.
5. Lactic acid causes fatigue, heavy legs, and later pain, depending on the length of time walking or standing.
6. The fatigue feeling tends to cause people to place themselves in inappropriate or awkward positions in an effort to remedy the feeling, again affecting other muscles, leading to pain in legs, back, head, etc.

With the insole of the invention, the movement of the liquid within the bladder will result in the user's body weight being more widely distributed over the area of the foot, thereby increasing the weight bearing surface area of the foot, and relieving peak pressures on the foot muscles. Again, the weight is not equally distributed on/over the plantar surface area of a normal foot, see FIG. 1-B. Further, the simultaneous movement of fluid within the bladder causes the small intrinsic foot muscles to move, which, combined with the pressure distribution effect, improves the venous pump function and thus avoiding the above chain reaction. Tests reveal that the insole of the invention reduces peak pressures, measured by the average pressure in kilograms per square centimeter against the plantar surface of the user's foot. The improved distribution of the user's weight is particularly applicable during standing or walking. It is important to avoid high pressure on heel and metatarsal bones, since such pressure can cause foot pain, hard skin, and, in extreme situations, ulceration. These abnormalities are well known in diabetic feet.

The weight of the user pressurizes the liquid within the bladder. The pressurized liquid will constantly move the non-loaded parts of the bladder upwards. Movement or weight shift by the user will cause fluid movement, whereby a constant movement of the small internal foot muscles occurs. A considerably improved venous pump function is thereby established in the foot itself. A constant massage of the foot sole occurs for each time weight distribution is changed by the movement of the fluid within the three regions. When the feet, and thus the weight, is placed on the insoles, a weight pressure redistribution action takes place between the feet and the insoles, stimulating the blood veins. The effect is a considerably improved venous pump function, which is obviously very important for any person participating in a standing, walking or running activity. The function of the blood is to transport oxygen and nutrients to the cells, and return waste products to be excreted from the user's kidneys, through the urine. Improved blood circulation will decrease the amount of lactic acid, an element known as causing fatigue or myasthenia. Blood circulation is thus very important to individuals applying their muscles extensively, since muscle exertion constrains the blood corpuscles, thus hampering the transport of nutrients and waste products. Another effect of insufficient blood supply is a reduction of the contraction ability of the muscles. The fluid filled insole of the invention enhances the location, degree and duration of beneficial pressure distribution as compared to the prior art vis-a-vis the flow of fluid that is specifically matched to the anatomical structure of the foot (FIGS. 1-B and 1-C). A positive effect is a reduction and in many instances elimination of the painful effect of soreness in feet, legs, and back caused by prolonged standing or walking.

The features that distinguish the current invention from the prior art is further the specific location of the flow deflectors and restrictors in the forefoot, midfoot and hindfoot regions, enabling a flow of fluid matched to the anatomical structure of the feet. The flow deflectors and restrictors and their following flow passages ensure directional stability during locomotion by enabling a controlled circulation of liquid that is matched to the anatomical structure of the normal foot. This is important since uncontrolled liquid circulation would result in unstable walking, unstable weight distribution, discomfort, and potentially the development of foot abnormalities. Directional stability, as achieved by the designed liquid circulation of the invention and as distinguishable over the prior art, ensures an anatomical locomotion pattern for the wearer, because the weight is anatomically distributed on the foot. The insole can alleviate the problems involved in over-supination and over-pronation, i.e., where the user's feet are turning abnormally either to the medial, inner side or the lateral, outer side of the foot ("asymmetric feet"). The combination of distribution of weight pressure and directionally stabilizing fluid circulation also supports a functionally correct take-off; a factor crucial for walking or running in a physiologically correct manner.

While the preferred embodiment of the present invention has been shown and described, it is to be understood that various modifications and changes could be made thereto without departing from the scope of the appended claims.

What is claimed is:

1. An improved insole adapted to be worn beneath a wearer's foot, the wearer's foot having a lateral longitudinal arch and a medial longitudinal arch and a border there between, said insole of the type in which a bladder is filled with a fluid, said bladder having a generally foot-shaped configuration with a proximal forefoot region, a hindfoot region and a midfoot region there between, wherein the improvement comprises:

at least one but no more than six transversely spaced flow deflectors in the proximal forefoot region of said bladder, said deflectors being spaced apart relative to one another;

at least two, but no more than seven forefoot flow passages between each of said flow deflectors and between said flow deflectors and the lateral and medial margins of the proximal forefoot region of said bladder, said forefoot flow passages having substantially equal transverse dimension, and at least one of said forefoot flow passages extending between the proximal forefoot region and the midfoot region of said bladder;

an elongated flow controller bridging the forefoot and midfoot regions of said bladder, the elongation of said flow controller extending in a longitudinal direction and substantially matching at least a portion of the border between lateral and the medial longitudinal arch of the wearer's foot, said flow controller controlling liquid flow from said hindfoot region to said proximal forefoot region and vice versa;

a pair of flow restrictors at the distal end of hindfoot region of said bladder, one of said restrictors extending laterally from the medial peripheral margin of said bladder and the other said restrictor extending medially from the lateral peripheral margin of said bladder, said pair of restictors defining a single longitudinal flow channel there between; and said fluid comprising a heavy, viscous liquid.

2. An insole as in claim 1 wherein said pair of flow restrictors in the distal end of the hindfoot region have substantially the same transverse dimension so that said flow channel there between is centrally located between the lateral and medial margins of said bladder, and wherein said flow channel has a transverse width at its narrowest point of between 10 and 30 percent of the maximum straight transverse width of the hindfoot region of the bladder.

3. An improved insole as in claim 1, wherein said bladder comprises an upper layer and a lower layer joined at their peripheral margins, said bladder further comprising a textile layer attached to and substantially covering at least one of said layers.

4. An improved insole as in claim 1, further comprising a solid or semi-solid shock absorbing material in said bladder covering at least a portion of said hindfoot region.

5. An improved insole as in claim 1, wherein said insole is incorporated into footwear.

6. An insole, adapted to underlie the anatomical structure of a wear's foot, the foot having a lateral longitudinal arch, a medial longitudinal arch and a longitudinal border there between, comprising a lower layer of substantially impermeable, flexible material;

an upper layer of substantially impermeable, flexible material;

said upper and lower layers being sealingly joined to one another at their peripheral margins, said upper and lower layers forming a substantially fluid tight bladder, said bladder having a generally planar, foot-shaped configuration having distal forefoot region, a proximal forefoot region, a hindfoot region and a midfoot region there between, and a liquid barrier between said distal forefoot region and said proximal forefoot region;

at least one but no more than six transversely spaced forefoot flow deflectors between said upper material layer and said lower material layer in said proximal forefoot region;

forefoot flow passages between said forefoot flow deflectors and between said forefoot flow deflectors and the medial and lateral margins of said bladder, each said forefoot flow passages having a substantially equal transverse dimension;

at least one of said forefoot flow passages extending between said proximal forefoot region and said midfoot region;

an elongated flow controller bridging the forefoot and midfoot regions of said bladder, the elongation of said flow controller substantially matching at least a portion of the longitudinal border between the medial longitudinal arch and the lateral longitudinal arch of the wearer's foot, said flow controller for directing flow from said hindfoot region to said forefoot region and vice versa;

a pair of flow restrictors at the distal end of the hindfoot region of said bladder, one of said restrictors extending laterally from the medial peripheral margin of said bladder and the other said restrictor extending medially from the lateral peripheral margin of said bladder, said pair of restrictors defining a single longitudinal flow channel there between, said channel being located substantially equal distance from the medial and lateral margins of said bladder; and a liquid within said bladder, said liquid flowable from said hindfoot region to said proximal forefoot region and vice versa, and said distal forefoot region being substantially liquid free.

7. An insole as in claim 6, wherein said liquid is a sterile, heavy liquid.

* * * * *